United States Patent [19]

Abel et al.

[11] 3,956,554

[45] May 11, 1976

[54] COATING FIBROUS SUBSTRATES

[75] Inventors: Heinz Abel, Reinach, Basel-Land; Melvin Harris, Dornach, both of Switzerland; Derek James Rowland Massy, Cambridge, England

[73] Assignee: Ciba-Geigy Corporation, Ardsley, N.Y.

[22] Filed: Aug. 30, 1973

[21] Appl. No.: 392,924

[30] Foreign Application Priority Data

Sept. 1, 1972 United Kingdom ..... 40648/72

[52] U.S. Cl. ..... 428/95; 428/419; 427/389; 427/390

[51] Int. Cl.[2] ..... D04H 11/00; B05D 3/00

[58] Field of Search ..... 117/140 A, 161 VC; 260/79.5 NV; 427/389, 390; 428/95, 419

[56] References Cited

UNITED STATES PATENTS

| | | | |
|---|---|---|---|
| 3,649,325 | 3/1972 | Affeldt | 117/140 X |
| 3,676,195 | 7/1972 | Kehr et al. | 117/140 X |
| 3,690,939 | 9/1972 | Wegmann | 117/126 |
| 3,706,527 | 12/1972 | Dobinson et al. | 117/141 |
| 3,706,528 | 12/1972 | Dobinson et al. | 117/141 |
| 3,714,290 | 1/1973 | Kehr et al. | 260/79.5 X |
| 3,770,602 | 11/1973 | D'Alelio | 117/140 X |

FOREIGN PATENTS OR APPLICATIONS

| | | | |
|---|---|---|---|
| 524,007 | 12/1969 | Switzerland | 117/126 |

*Primary Examiner*—Cameron K. Weiffenbach
*Assistant Examiner*—R. Eugene Varndell, Jr.
*Attorney, Agent, or Firm*—Joseph G. Kolodny; Edward McC. Roberts; Prabodh I. Almaula

[57] ABSTRACT

Carpets are backed with a composition comprising i. a polymercaptan containing at least two mercatpan groups per average molecule, ii. a polyene having, per average molecule, at least two ethylenic double bonds each $\beta$ to an atom of nitrogen, sulfur, or oxygen, the sum of the mercaptan groups in the polymercaptan and of such ethylenic double bonds in the polyene being more than 4, and the composition is then cured on the carpet with or without the application of heat, optionally in the presence of a Brønsted acid, a Brønsted base, or a source of free radicals, as a curing accelerator. Such carpet backings cure at relatively low temperatures and so may be used in conjunction with a wide range of fibers and dyestuffs: the backings also retain their flexibility for prolonged periods.

17 Claims, No Drawings

COATING FIBROUS SUBSTRATES

This invention relates to processes for coating fibrous substrates and to the fibrous substrates coated by such processes; in particular, it relates to processes for backing a carpet, and carpets provided with a backing by such processes.

Increasingly, curable, rubber-like preparations are being used in making carpets. They are applied, ordinarily as a thick paste, to a backing fabric and then cured. In tufted carpets they anchor the tufts of yarn to the backing fabric; applied to the backs of woven carpets, they prevent fraying of the carpet when it is cut. They also contribute to the sound-insulating properties of the carpet. Rubbery materials commonly employed for backing carpets are poly(butadiene) latices, which may include another olefin, e.g., styrene, as comonomer. High temperatures, of the order of 150° to 170°C, are needed for satisfactory curing of these materials and this is a disadvantage because the range of fibres and of dyestuffs whch can be used satisfactorily with them is limited. A further disadvantage is that the cured rubbery materials become brittle quite soon, particularly on exposure to underfloor heating, the carpet backing then having inadequate resistance to wear arising through, amongst other things, the movement over it of heavy furniture.

We have found that these disadvantages can be substantially overcome by employing as the carpet backing certain curable compositions containing polyenes and polymercaptans. By the use of these polyenes and polymercaptans, compositions can be obtained which cure rapidly at temperatures considerably below 150°C and which form products retaining their flexibility for prolonged periods.

There is accordingly provided a process for backing a carpet which comprises 1. applying to the back of the carpet a curable composition comprising
   i. a polymercaptan containing, per average molecule, at least two mercaptan groups
   ii. a polyene having, per average molecule, at least two ethylenic double bonds, each $\beta$ to an atom of nitrogen, sulphur, or oxygen, the sum of the mercaptan groups in the said polymercaptan and of such ethylenic double bonds in the said polyene being more than 4, and preferably from 5 to 8, and
2. curing the composition on the back of the carpet.

Ordinarily, the polyene and the polymercaptan are applied as a mixture, but it is within the scope of the invention to apply the polyene and the polymercaptan to the carpet back in either sequence and form the composition in situ. "Curing" includes "allowing to cure".

A wide range of polymercaptans is suitable for use as component (i) in the composition of this invention.

One class, which is preferred because of the ready availability of many of its members, comprises esters of monomercaptancarboxylic acids with polyhydric alcohols and a monomercaptanmonohydric alcohols with polycarboxylic acids.

Further preferred such esters are of the formula

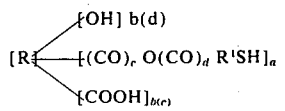

I where

R represents an aliphatic or araliphatic hydrocarbon radical of at least 2 and at most 60 carbon atoms, which may contain not more than one ether oxygen atom, $R^1$ represents a hydrocarbon radical, which may contain not more than one carbonyloxy group, and is preferably of from 1 to 4 carbon atoms,

*a* is an integer of from 2 to 6,

*b* is zero or a positive integer of at most 3, such that $(a + b)$ is at most 6, and

*c* and *d* each represent zero or 1, but are not the same.

Yet further preferred among the polymercaptans of formula I are those which are also of the formula $$R^2 (OCOR^3SH)_a \qquad \text{II}$$

where

*a* has the meaning previously assigned, $R^2$ is an aliphatic hydrocarbon radical of from 2 to 10 carbon atoms, and $R^3$ denotes $—CH_2—$, $—(CH_2)_2—$, or $$\begin{array}{c} CH_3 \\ | \\ —CH— \end{array}.$$

These esters are described in United Kingdom Pat. Specification No. 1316416.

Also preferred are mercaptan-containing polyesters, including esters of monomercaptandicarboxylic acids, of formula $$R^6—(O)_g CO(O)_h R^4(O)_h CO(O)_g R^5SH)_f \qquad \text{III}$$

where

*f* is an integer of from 1 to 6,

*g* and *h* are each zero or 1 but are not the same, $R^4$ represents a divalent organic radical, linked through a carbon atom or carbon atoms thereof to the indicated —O— or —CO— units, $R^5$ represents a divalent organic radical, linked through a carbon atom or carbon atoms thereof to the indicated —SH group and —O— or —CO— units, and $R^6$ represents an organic radical, which must contain at least one —SH group when *f* is 1, linked through a carbon atom or carbon atoms thereof to the indicated —O— or —CO— units.

Preferably, when *g* is zero, $R^4$ denotes a saturated aliphatic hydrocarbon chain of 2 to 250 carbon atoms, which may be substituted by methyl groups and by —SH groups and which may be interrupted by ether oxygen atoms and by carbonyloxy groups; when *g* is 1, $R^4$ preferably denotes a. a saturated aliphatic hydrocarbon group of 2 to 10 carbon atoms which may bear an —SH group, b. a cycloaliphatic-aliphatic hydrocarbon group of 5 to 34 carbon atoms, which may contain ethylenic unsaturation, or c. a mononuclear arylene hydrocarbon group of 6 to 12 carbon atoms.

When *g* is zero, $R^5$ preferably denotes a saturated aliphatic hydrocarbon group of 1 to 3 carbon atoms, which may bear a carboxyl group, and, when *g* is 1, a saturated aliphatic hydrocarbon group of 2 to 4 carbon atoms which may be substituted by a hydroxyl group or by a chlorine atom. $R^6$ preferably denotes a. an aliphatic or cycloaliphatic-aliphatic hydrocarbon group of 2 to 51 carbon atoms, which may bear at least one —SH group, b. a mononuclear or dinuclear arylene hydrocarbon group of 6 to 15 carbon atoms, c. a chain of 4 to 250 carbon atoms, interrupted by at least one ether oxygen atom and optionally substituted by at least one —SH group, or d. a chain of 6 to 750 carbon atoms, interrupted by at least one carbonyloxy group, optionally interrupted by at least one ether oxygen atom and optionally substituted by at least one —SH group.

These esters are described in United Kingdom Pat. Specifications Nos. 1311090 and 1315820.

Also suitable are esters and ethers which are of the general formula

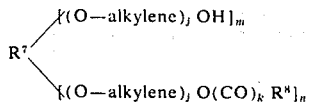

IV where each "alkylene" group contains a chain of at least 2 and at most 6 carbon atoms between consecutive oxygen atoms, $j$ is a positive integer such that the average molecular weight of the polymercaptan is at least 400, but preferably not more than 10000, $k$ is zero or 1, $m$ is zero or a positive integer such that $(m + n)$ is at most 6, $n$ is an integer of from 2 to 6, $R^7$ represents the radical of a polyhydric alcohol after removal of $(m + n)$ alcoholic hydroxyl groups, and $R^8$ represents an aliphatic radical containing at least one mercaptan group.

"Alkylene" units in individual poly(oxyalkylene) chains may be the same or different and they may be substituted by e.g., phenyl or chloromethyl groups. Preferably they are $—C_2H_4—$ or $—C_3H_6—$ groups.

Preferred amongst the compounds of formula IV are the esters of formula

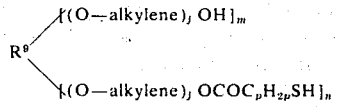

V and the ethers of formula

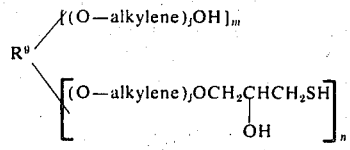

VI where

"alkylene" and $j$, $m$, and $n$ have the meanings previously assigned, $R^6$ represents an aliphatic hydrocarbon radical of from 2 to 6 carbon atoms, and $p$ is 1 or 2.

These esters and ethers are described in United Kingdom Pat. Specification No. 1278934.

Yet other suitable polymercaptans are mercaptan-terminated polysulphides of the general formula

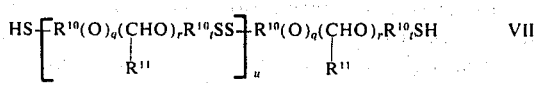

VII where each $R^{10}$ denotes an alkylene hydrocarbon group containing from 2 to 4 carbon atoms, $R^{11}$ denotes —H, $—CH_3$, or $—C_2H_5$, $u$ is an integer which has an average value of at least 1, and is preferably such that the average molecular weight of the polysulphide is at most 10000, and either $q$ is zero, in which case $r$ and $t$ are each also zero, or $q$ is 1, in which case $r$ is zero or 1 and $t$ is 1.

The preferred polysulphides are those of formula VII where $R^{11}$ denotes hydrogen and $q$ and $r$ are each 1, $u$ being such that the molecular weight of the polysulphide is from 500 to 8000.

These polysulphides are described in, inter alia, United Kingdom Pat. Specification No. 1316579.

Another class of polymercaptans comprises mercaptan-terminated poly(butadienes) of the formula

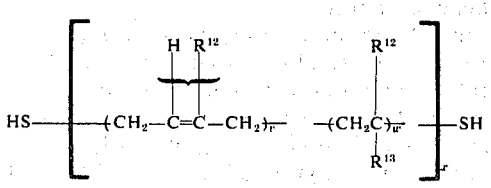

VIII where each $R^{12}$ represents —H or $—CH_3$, $R^{13}$ represents —CN, —COOH, $—CONH_2$, $—COOR^{14}$, $—C_6H_5$, or $—OCOR^{14}$, where $R^{14}$ is an alkyl group of one to eight carbon atoms, $v$ is an integer of at least one, $w$ is zero or a positive integer, and $x$ is an integer such that the average number molecular weight of the polymercaptan is at least 500, but preferably not more than 10000.

Preferably the polymercaptans of formula VIII are also of the formula

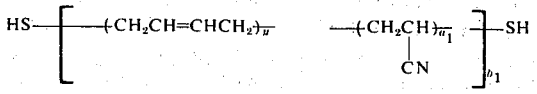

IX where $a_1$ is either zero, in which case $y$ is 1, or it is 1, in which case $y$ is an integer of from 2 to 5, and $b_1$ is an integer such that the average molecular weight of the polymercaptan is at least 1250 and at most 5000.

Also suitable are the polymercaptans of the formula

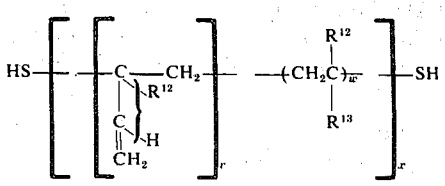

X and particularly those of the formula

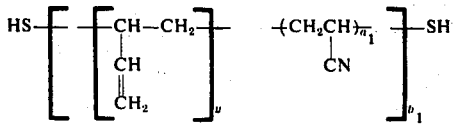

XI where $R^{12}$, $R^{13}$, $v$, $w$, $x$, $y$, $a_1$, and $b_1$ have the meanings previously assigned.

These polymercaptans are described in United Kingdom Pat. Specification No. 1315124.

Yet another suitable class of polymercaptans comprises the mercaptan-terminated polyoxyalkylenes of the general formula

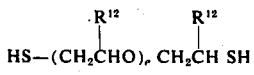

XII where each $R^{12}$ has the meaning previously assigned and $e$ is an integer of from 1 to 4.

As already indicated, the polyenes employed contain at least two ethylenic double bonds, each $\beta$ to an atom of oxygen, nitrogen, or sulphur; these heteroatoms, which are for preference oxygen, may be the same or different.

Polyenes preferred for the purposes of this invention have average molecular weights in the range 250 to 10000, and further preferred are those having at least two ethylenic double bonds each $\alpha$ to a carbonyloxy group, particularly those of the formula

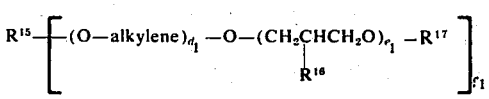

XIII where $d_1$ is zero or a positive integer of value such that the average molecular weight of the polyene does not exceed 10000, $e_1$ is zero or 1, $c_1$ is an integer of at least 1, but generally at most 6, and is preferably 2 or 3, $R^{15}$ denotes the radical, preferably containing not more than 60 carbon atoms, remaining after removal of $c_1$ OH groups from a compound having at least $c_1$ alcoholic or phenolic hydroxyl groups or the acyl radical remaining after removal of $c_1$ OH groups from a compound having at least $c_1$ COOH groups, "alkylene" has the meaning previously assigned, $R^{16}$ represents a group of formula —OH or —$OOCR^{18}$, where $R^{18}$ represents —H or a monovalent hydrocarbon group, preferably of not more than 10 carbon atoms, which may bear carboxyl or alkoxycarbonyl substituents, $R^{17}$ represents —H, a monovalent acyl group, preferably containing not more than 10 carbon atoms, or the residue, after removal of an —OH group, of an alcohol, with the provisos that $R^{15}$ and $R^{17}$ do not both represent acyl if $d_1$ and $e_1$ both denote zero and that $R^{17}$ does not represent —H if $e_1$ is 1, there being a total of at least two ethylenic double bonds $\alpha$ to carbonyloxy groups in the group $R^{15}$, and/or in the $c_1$ groups $R^{17}$, and/or in the $e_1$ $c_1$ groups $R^{18}$ if present.

Yet further preferred are polyenes of formula XIII in which $R^{17}$ represents the monoacyl residue of a saturated or ethylenically unsaturated mono- or di-carboxylic acid, and particularly a group of formula

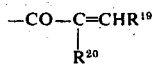

XIV where $R^{20}$ denotes —H, —Cl, —Br, or an alkyl group of 1 to 4 carbon atoms, and $R^{19}$ denotes —H, —COOH, or a group of the formula

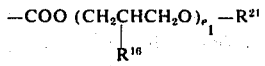

XV where $R^{16}$ and $e_1$ have the meanings previously assigned and $R^{21}$ denotes —H, an alkyl, aryl, aralkyl, or alkenyl hydrocarbon group or an aliphatic, aromatic, or araliphatic acyl group, such that the group $R^{19}$ contains not more than 24 carbon atoms.

$R^{18}$ preferably represents a group containing from 2 to 16 carbon atoms and bearing either one —COOH group or one alkoxycarbonyl group containing from 1 to 13 carbon atoms, and especially it denotes —CH = CHCOOH or —$CH_2CH_2COOH$.

$R^{15}$ preferably represents an aliphatic radical containing from 3 to 60 carbon atoms, especially a saturated hydrocarbon radical of not more than 6 carbon atoms, or a radical of the formula

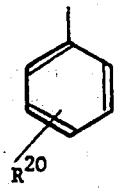

XVI

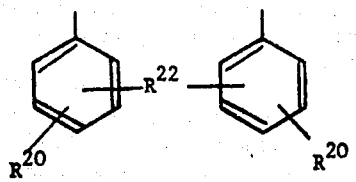

XVII

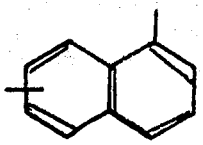

XVIII

-continued or

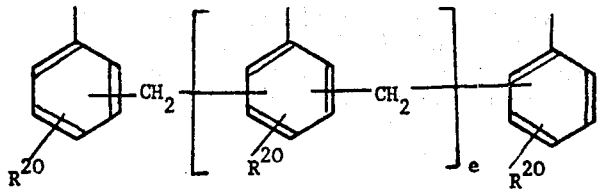

XIX where each $R^{20}$ has the meaning previously assigned, $R^{22}$ denotes a carbon-carbon bond, an alkylene hydrocarbon group of from 1 to 4 carbon atoms, or an ether oxygen atom, and $e$ has the meaning previously assigned.

Compounds of formula XIII, where $R^{15}$ is the radical remaining after removal of $c_1$ OH groups from an alcohol containing at least $c_1$ alcoholic hydroxyl groups or, providing $d_1$ is at least one, the acyl radical remaining after removal of $c_1$ OH groups from a carboxylic acid containing at least $c_1$ carboxylic acid groups or the aryl radical remaining after removal of $c_1$ OH groups from a phenol containing at least $c_1$ phenolic hydroxyl groups, are obtainable by esterifying the alcohol of formula $$R^{15}\text{+(O-alkylene)}_{d_1}\text{OH]}_{c_1} \qquad \text{XX}$$

with a carboxylic acid of formula $HOR^{17}$ or its anhydride or acid chloride, in the case where $e_1$ is zero, while those where $e_1$ is 1 are obtainable by converting the alcohol of formula XX into its glycidyl ether of formula $$R^{15}\left[\text{(O—alkylene)}_{d_1}\ \text{OCH}_2\text{CH—CH}_2\ \text{(epoxide)}\right]_c \qquad \text{XXI}$$

followed by opening of the indicated epoxide ring through reaction with the carboxylic acid of formula $HOR^{17}$.

Compounds of formula XIII, where $R^{15}$ is the acyl radical remaining after removal of $c_1$ OH groups from a carboxylic acid containing at least $c_1$ carboxylic acid groups and $d_1$ is zero, are obtainable by esterification of the carboxylic acid of formula $R^{15}(OH)_{c_1}$ or its anhydride with an alcohol of formula $R^{17}OH$, where $e_1$ is zero, while those where $e_1$ is 1 are obtainable by reaction of the acid $R^{15}(OH)_{c_1}$ with a glycidyl ether or a glycidyl ester.

Compounds of formula XIII, where $R^{15}$ is the aryl radical remaining after removal of $c_1$ OH groups from a compound having at least $c_1$ phenolic hydroxyl groups and $d_1$ and $e_1$ are each zero, are obtainable by esterifying the phenol of formula $$R^{15}\ (OH)_{c_1} \qquad \text{XXII}$$

with a carboxylic acid of formula $HOR^{17}$ or its anhydride or acid chloride, while those where $d_1$ is zero and $e_1$ is 1 are obtainable by converting the phenol of formula XXII into its glycidyl ether of formula $$R^{15}\ \text{(OCH}_2\text{CH——CH}_2)_{c_1} \qquad \text{XXIII}$$

followed by opening of the indicated ring through reaction with the carboxylic acid of formula $HOR^{17}$, or by reaction of the phenol XXII with the appropriate glycidyl ether or ester.

Usually, the polymercaptan is employed in a quantity sufficient to supply from 0.8 to 1.1 mercaptan groups per said ethylenic double bond of the polyene: the optimum amounts, and the relative proportion of the polymercaptan and the polyene required for satisfactory curing, may readily be ascertained by simple experiment.

Desirably, the polymercaptan contains up to 6 mercaptan groups per average molecule and at least one of the polyene and the polymercaptan has an average molecular weight in the range 1000 to 6000.

Advantageously the compositions contain an accelerator for the reaction between the polyene and the polymercaptan, and preferably this accelerator is an organic or inorganic Brønsted base or acid, or a free-radical catalyst. The last are of general applicability and include organic and inorganic peroxides and persalts such as benzoyl peroxide, hydrogen peroxide, tert.butyl hydroperoxide, di-isopropyl peroxydicarbonate, and ammonium persulphate. For polyenes which do not contain ethylenic double bonds $\alpha$ to carbonyloxy groups Brønsted acids may also be used. Examples of suitable such acids are sulphuric, phosphoric, and hydrochloric acids, also aromatic sulphonic acids such as toluene-p-sulphonic acid. For the preferred polyenes, i.e., those having ethylenic double bonds $\alpha$ to carbonyloxy groups, Brønsted bases may be used. Examples of suitable bases are primary, secondary, and tertiary amines, such as triethylamine, N,N-dimethylaniline, and N-benzyldimethylamine, lower alkanolamines (e.g., mono-, di-, and tri-ethanolamine), lower alkylene polyamines (e.g., ethylenediamine, diethylenetriamine, triethylenetetramine, tetraethylenepentamine, propane-1,2-diamine, propane-1,3-diamine, and hexamethylenediamine), also quaternary ammonium bases such as tetramethylammonium hydroxide, and water-soluble inorganic hydroxides (especially sodium hydroxide) and inorganic salts such as trisodium phosphate, sodium carbonate, sodium bicarbonate, sodium pyrophosphate, and sodium acetate.

The carpet will usually have a conventional secondary backing material such as a loosely woven cloth (e.g. hessian) or a nonwoven cloth (e.g. a web of nylon or polyester fibres bonded at points of fibre-to-fibre contact and/or needle-punched). Fibres anchored in the backing by means of the method of this invention may be of wool, cotton, polyester, nylon, polypropylene, poly(acrylonitrile) or modified poly(acrylonitrile) i.e., a "modacrylic", or blends of these fibres. The composition is generally applied to the secondary backing material as a paste by customary means to form a thick layer which serves to anchor the tufts or loops of the pile of the carpet.

Compositions employed in the method of this invention may be cured, i.e., converted into an insoluble, infusible solid, without the application of heat, but, if desired, curing may be accelerated by heating them to a temperature of at least 60°C, but preferably not more than 180°C; for most purposes, a temperature in the range 80° to 130°C is particularly convenient. If wished, the composition may be cured in two stages; first, it is heated sufficiently for it to gel but not to cure, and if desired, a pattern is imprinted on the backing, e.g., by passing the carpet through cold, embossed rollers, for decorative purposes or to give a nonslip finish, and curing is then completed by further heating.

The compositions may be applied as foams. The foams can be obtained in several ways.

In one method a gas (air, carbon dioxide, or nitrogen, for example) is incorporated by blowing or whipping it into a liquid mixture of the polyene and polymercaptan: usually the components of the mixture must have undergone partial cross-linking so that the viscosity of the mixture is sufficiently high for an adequate proportion of the gas bubbles to be retained.

In another method bubbles of gas or vapour are generated in situ. These may be produced by a blowing agent which is stable at room temperature but which decomposes to evolve an inert gas, generally nitrogen or carbon dioxide, at temperatures reached by the mixture, either spontaneously through the curing reaction, which is ordinarily exothermic, or on the external application of heat. Examples of blowing agents are 2,2′-azobis(2-methylpropionitrile), p,p′-oxybis (benzenesulphonyl) hydrazide), azodicarbonamide, dinitrosopentamethylenetetramine, sodium bicarbonate, and ammonium bicarbonate. There may be employed in a similar manner substances which are liquid at room temperature under atmospheric pressure but which boil at the temperatures reached by the mixture, either by an exothermic curing reaction or by the application of heat; usually these are inert organic liquids which can be readily dispersed, e.g., as an emulsion, in the polyene and/or the polymercaptan. They are generally water-immiscible and boil, under atmospheric pressure, at between 30° and 100°C. Specific classes of these organic liquids are paraffin hydrocarbons of up to 6 carbon atoms, such as n-pentane, and chlorinated, brominated or fluorinated paraffins of up to 3 carbon atoms, such as trichlorotrifluorethane.

Another way of generating bubbles of gas in situ is to incorporate a substance which evolves a gas on reaction with the polyene or the polymercaptan. A particularly convenient procedure entails employing as component (ii) a polyene containing a free carboxyl group in conjunction with an alkali metal or alkaline earth metal carbonate or bicarbonate. Suitable carboxyl-containing polyenes include those of formula $$R^{15}[(\text{O-alkylene})_{d_1}\text{OOCCH}=\text{CHCOOH}]_{c_1} \qquad \text{XXIV}$$

where $R^{15}$, 'alkylene', $d_1$, and $c_1$ have the meanings previously assigned.

Carbonates and bicarbonates of alkali metals and alkaline earth metals, being Brønsted bases, also serve to accelerate the reaction between the polyene and the polymercaptan. They may be added as aqueous solutions, a moderate amount of water not being detrimental to forming the foam.

The nature and amount of the blowing agent to be employed will depend on the circumstances under which the foam is to be produced. To obtain satisfactory foams it is important to employ conditions such that a sufficient proportion of the gas is retained in the mixture: if the viscosity of the mixture is too low, too much of the gas may escape, while, if curing has advanced too far, the gas bubbles will not be able to expand adequately. The optimum conditions for foaming can, however, readily be determined by routine experimentation using methods familiar to those skilled in the art. In some cases, of course, it may be desirable to apply the backing composition as a foam but to allow or cause the foam to collapse before the composition cures.

The compositions may contain fillers and thickening agents such as calcium carbonate, silica flour, barytes, kaolin, and finely-divided polymers such as cured urea-formaldehyde resins. They may also contain pigments. Particularly if the polyene and/or the polymercaptan has a poly(oxyalkylene) chain they may also contain substances which stabilise the cured product against adverse effects of light. Suitable stabilisers include compounds having at least one phenolic hydroxyl group and at least one alkyl or alkoxyl group of 1 to 8 carbon atoms in the same benzene ring, especially compounds having 1 to 4 benzene rings, at least one of which bears a phenolic hydroxyl group ortho to such an alkyl or alkoxy group. Specific examples of suitable stabilisers include 1,1-bis(3,5-di-tert.butyl-2-hydroxyphenyl)butane, 1,1-bis(3-tert.butyl-2-hydroxyphenyl)-butane, 1,1-bis(2-tert.butyl-4-hydroxy-6-methylphenyl)butane, bis(3-tert.butyl-2-hydroxy-5-ethylphenyl)methane, bis(3-tert.butyl-4-hydroxy-6-methylphenyl) sulphide, octadecyl 3-(3,5-di-tert.butyl-4-hydroxyphenyl)-propionate, pentaerythrityl tetrakis(3-(3,5-di-tert.butyl-4-hydroxyphenyl)-propionate), and the nickel complex of formula

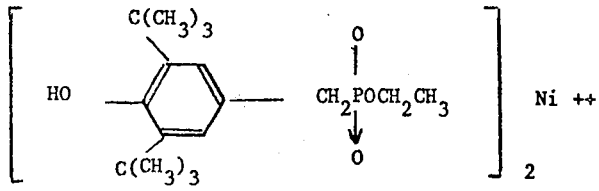

XXV

Usually, about 0.1 to 5% by weight of the stabiliser, calculated on the weight of the poly(oxyalkylene)-containing polymercaptan and/or polyene, is employed.

The following Examples illustrate the invention. Parts are by weight and temperatures are given in degrees Celsius.

Polyols I, II, III, IV, and V are polyoxypropylene triols (adducts of glycerol and propylene oxide), of average molecular weights 4000, 700, 480, 600, and 1500, respectively.

Polythiol A, the trithioglycollate of a long-chain polyhydric alcohol, was made in the following manner.

Polyol I, (800 g), 55.2 g of thioglycollic acid, 5 g of toluene-p-sulphonic acid, and 350 ml of toluene were heated to reflux with stirring in an atmosphere of nitrogen. Water (10.8 ml) formed during the reaction was removed as its azeotrope with toluene. The mixture was cooled and washed with water, and the organic layer was separated. On removal under vacuum of the solvent from the organic layer there remained 793 g (94% of the theoretical yield) of the desired trithioglycollate, having a thiol content of 0.59 equiv./kg and being of the formula

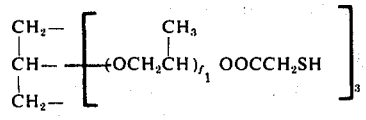

XXVI where $f_1$ is an integer of average value 22.5.

Polythiol B is similar to Polythiol A but was made from Polyol II i.e., $f_1$ in formula XXVI denotes an integer of average value 3.5.

Polythiol C denotes a polysulphide which is essentially of the average formula

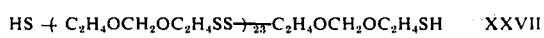

XXVII

Polythiol D denotes the tri(3-mercapto-2-hydroxypropyl) ether of Polyol III: it is essentially of the formula

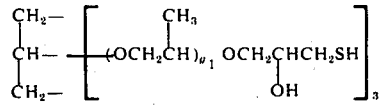

where $g_1$ represents an integer of average value 2.2.

Polythiol E denotes pentaerythritol tetrathioglycollate.

Polythiol F is similar to Polythiol A but is made from Polyol IV: it is substantially of formula XXVI, where $f_1$ denotes an integer of average value 2.9.

Polythiol G is a mercaptan-terminated polyester, made by heating to reflux glycerol (1 mol.), adipic acid (4 mol.), butane-1,4-diol (4 mol.), and thioglycollic acid (3 mol.) in perchloroethylene with stirring for 5 hours under nitrogen, in the presence of toluene-p-sulphonic acid as catalyst, water formed during the reaction being removed as its azeotrope. The mixture was washed with water until the washings had a pH of 5 to 6, then the perchloroethylene was distilled off under reduced pressure.

Polythiol H, also a mercaptan-terminated polyester, was made similarly, from 1 mol. of 1,1,1-trimethylolpropane, 2 mol. of adipic acid, 2 mol. of polyoxypropylene glycol of average molecular weight 425, and 3 mol. of 3-mercaptopropionic acid.

Polythiol J is 1,1,1-trimethylolpropane trithioglycollate.

Polythiol K is 1,2-bis(2-mercaptoethoxy)ethane.

Polythiols L and M are mercaptan-terminated polyesters made similarly to Polythiol G, from, respectively, 3 mol. of polyoxypropylene glycol of average molecular weight 1025, 2 mol. of thiomalic acid, and 2 mol. of thioglycollic acid, and 3 mol. of polyoxyethylene glycol of average molecular weight 600, 2 mol. of thiomalic acid, and 2 mol. of thioglycollic acid.

Polythiol N is glycerol trithioglycollate.

Polyolefin A denotes the tris(3-carboxyacrylate) of Polyol I, and it was made in this way:

A mixture of Polyol I (200 g), 14.7 g of maleic anhydride, and 2 g of N-benzyldimethylamine was stirred at 120° for 100 minutes. The product, Polyolefin A, is substantially of the formula

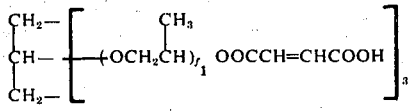

XXIX where $f_1$ has the meaning assigned in formula XXVI.

Polyolefin B is substantially a 3-n-butoxy-2-hydroxypropyl ester of Polyolefin A, made in the following manner. To 536.5 g of Polyolefin A, heated at 120° was added, while stirring, 49 g (0.9 molar proportion) of n-butyl glycidyl ether (epoxide content 7.1 equiv./kg) and stirring was continued at 120° for 100 minutes, by which time the epoxide content of the product was zero.

Polyolefin B has the average formula

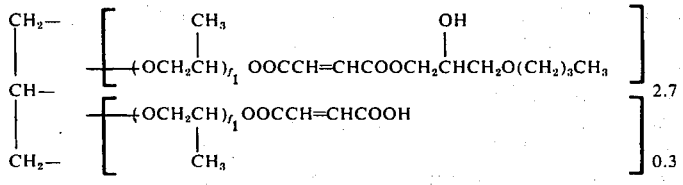

XXX where $f_1$ has the meaning assigned in formula XXVI.

Polyolefin C is the tri(3-methacryloxy-2-hydroxy-n-propyl) ether of Polyol II, and was prepared as follows:

The triglycidyl ether (500 g) of Polyol II (having an epoxide content of 2.7 equiv./kg), methacrylic acid (116 g), triethylamine (6 g), and hydroquinone (0.5 g) were stirred together at 80° for 2 hours and then at 120° for 3 hours, by which time the epoxide content of the product had fallen to zero.

Polyolefin C is substantially of the formula

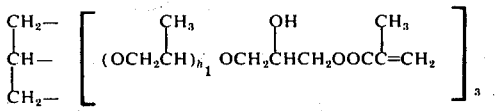

XXXI where $h_1$ is an integer of average value 3.5.

Polyolefin D was prepared similarly. Thus, the triglycidyl ether (epoxide content 0.58 equiv./kg) of Polyol I (200 g) was added dropwise over 60 minutes to 8.4 g of acrylic acid, containing 1% of triethylamine and 0.1% of hydroquinone, stirred at 120°. Heating with stirring at 120° was continued until the epoxide content of the product had fallen to less than 0.02 equiv./kg. Polyolefin D is substantially of formula XXXIV where $m_1$ denotes an integer of average value 22.5.

Polyolefin E was prepared by heating under nitrogen 500g of a poly(oxypropylene) glycol of average molecular weight 2000 with 49 g of maleic anhydride at 80° for 45 minutes and then for 1 hour at 120° in the presence of 5 g of N-benzyldimethylamine: to the product was added n-butyl glycidyl ether of epoxy value 7.05 equiv./kg (71 g) and the mixture was heated under an atmosphere of nitrogen for 1¾ hours at 120°. Polyolefin E is substantially of the formula

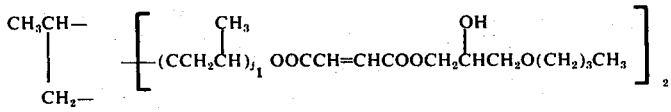

XXXII where $j_1$ denotes an integer of average value 16.6.

Polyolefin F was obtained by heating 3 kg of Polyol V, maleic anhydride (588 g), and triethylamine (25 g) for 2 hours at 80°. It was an amber liquid, containing 1.72 ethylenic double bond equiv. per kg: it is substantially of formula XXIX, where $f_1$ denotes an integer of average value 8.1.

Polyolefin G was prepared in a similar manner, employing 1.2 kg of Polyol IV in place of the 3 kg of Polyol V: it is substantially of formula XXIX, where $f_1$ denotes an integer of average value 2.9.

Polyolefin H was prepared by adding freshly distilled acrylyl chloride (20 g) to a stirred solution of Polyol I (200 g) and triethylamine (22g) in 200 g of dry acetone, stirring the mixture for 1 hour at room temperature, and then heating to reflux for 5 hours. The product was filtered, 0.2g of p-methoxyphenol was added to inhibit polymerisation, and the acetone was evaporated off under reduced pressure. Polyolefin H is substantially of the formula

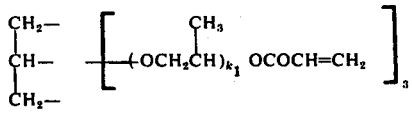

XXXIII where $k_1$ denotes an integer of average value 22.5.

Polyolefin J was made by stirring 500 g of the triglycidyl ether of Polyol II (epoxide content 2.7 equiv./kg), acrylic acid (97 g), triethylamine (6 g), and hydroquinone (0.5 g) at 80° for 2 hours and then at 120° for 3 hours, at which time the epoxide content of the mixture had fallen to zero.

The product, Polyolefin J, is substantially of the formula

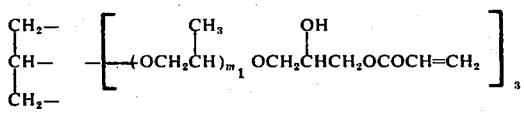

XXXIV where $m_1$ is an integer of average value 3.5.

Polyolefin K was prepared by mixing 384 g of the diglycidyl ether of 2,2-bis(p-hydroxyphenyl)propane (epoxide content 5.2 equiv./kg) with 144 g of acrylic acid in the presence of N-benzyldimethylamine (5.3 g) and p-methoxyphenol (0.53 g), and heating to 120° for 2 hours. The product, Polyolefin K, is of the formula

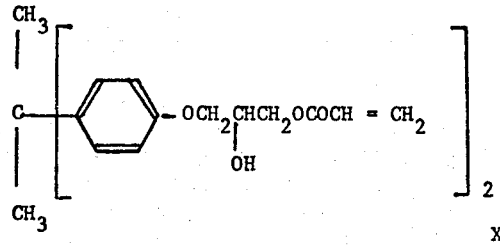

XXXV

EXAMPLE 1

A composition prepared by thoroughly mixing 200 parts of Polythiol A, 160 parts of Polyolefin A, 100 parts of precipitated calcium carbonate, and 2 parts of N,N-dimethylaniline was applied to a needle-punched backing fabric by means of a roller or a doctor blade. The treated fabric was heated for 10 minutes at 120° to cure the composition. A tough, rubbery layer was obtained, adhering firmly to the backing fabric.

In other experiments similar results were obtained using compositions prepared from the following:

200 parts Polythiol A
180 parts Polyolefin B
50 parts precipitated calcium carbonate
2 parts triethylamine or 200 parts Polythiol B
1000 parts Polyolefin A
200 parts precipitated calcium carbonate.

EXAMPLE 2

A composition was similarly prepared from 200 parts of Polythiol A, 160 parts of Polyolefin A, 240 parts of precipitated calcium carbonate, and 5.5 parts of N,N-dimethylaniline. It was applied to a backing fabric and cured by heating for 15 minutes at 70° or 10 minutes at 120°.

Another composition, consisting of 200 parts of Polythiol A, 175 parts of Polyolefin B, 240 parts of calcium carbonate, and 20 parts of triethanolamine, was applied and cured by heating for 10 minutes at 80° or 5 minutes at 120°.

In artificial ageing tests, carried out according to DIN Standard 53608, in which samples are kept for 1 week at 70°, conventional carpet backings made of a poly(butadiene) became dry and brittle, while those prepared by curing Polythiol A with Polyolefin A were virtually unaltered: In abrasion tests, where the backings were subjected to traverses of a loaded plastic cone, conventional backings became roughened after 5 to 20 traverses, whereas those prepared by curing Polythiol A with Polyolefin B were completely resistant to 150 or more such traverses.

EXAMPLE 3

The following mixtures were made, the figures denoting parts.

| | a | b | c | d | e |
|---|---|---|---|---|---|
| Polyolefin C | 10 | — | — | — | — |
| Polyolefin D | — | 40 | — | — | — |
| Polyolefin E | — | — | 36 | — | — |
| Polyolefin F | — | — | — | 36 | — |
| Polyolefin G | — | — | — | — | 10 |
| Polythiol C | 40 | — | — | — | 40 |
| Polythiol D | — | 8 | 12 | — | — |
| Polythiol E | — | — | — | 6 | — |
| China clay | 25 | 25 | 25 | 25 | 25 |
| Diethylenetriamine | 0.5 | 0.5 | 0.5 | 0.5 | 0.5 |

The Polyolefin and Polythiol were mixed with the china clay, then the diethylenetriamine was stirred in and the composition was spread rapidly by means of a broad-bladed knife on the rear of a jute-backed carpet having an undyed, looped nylon pile and weighing 1.3 kg/sq.m. The compositions, which were applied at the rate of 2.67 kg/sq.m. in the case of a, 3.13 kg/sq.m. in the case of b and c, and 2.2 kg/sq.meter in the case of d and e, cured at room temperature to opaque, rubbery coatings.

The force required to pull a loop out of an untreated carpet was measured by an Instron machine and found to be 10 Newtons. An attempt was made to measure the force required to extract a loop in the case of carpet backed with composition d but the adhesion was so high that measurement was not possible, the nylon fibres breaking under a tension of 50 Newtons.

EXAMPLE 4

The procedure of Example 3 was repeated, the polyene being Polyolefin C (25 parts) and the polymercaptan Polythiol F (25 parts); the carpet used had an undyed, looped nylon pile and was backed with polypropylene, and the composition was applied at the rate of 3.32 kg/sq.m.

The force required to extract a loop from the untreated carpet was 5 Newtons, but that required to extract a loop from the treated carpet again could not be measured, the fibres breaking under a tension of 66 Newtons.

EXAMPLE 5

A 50% emulsion of Polythiol A was prepared by vigorously stirring 50 g of the polythiol with 40 g of water containing 10 g of an emulsifying agent (an adduct of 1 mol. p-nonylphenol with 9 mol. of ethylene oxide). A 50% emulsion of Polyolefin A was prepared similarly from 50 g of the polyene and 47.5 g water with 2.5 g of an emulsifying agent (an adduct of 70 mol. of ethylene oxide with 1 mol. of mixed n-alkylamines containing 16 or 18 carbon atoms).

The two emulsions were mixed with 41.7 g of precipitated calcium carbonate and the resultant foaming paste was put on the back of a carpet by means of a doctor knife. The composition was dried and cured by heating it for 20 minutes at 120°.

A film of the paste prepared above was cast and then cured as before, and the tensile strength and breaking extension of the film was measured by means of an Instron tensile tester, following the procedure laid down in SNV (Schweizerische Normen Verein) 198/461. A similar film comprising a conventional carpet backing agent, containing a carboxylated butadiene-styrene latex, was also tested. The results obtained were:

| | Tensile strength (kg/cm) | Extension at break (%) |
|---|---|---|
| Polyene-Polythiol | 0.46 ± 0.03 | 95 |
| butadiene-styrene latex | 0.31 ± 0.02 | 55 |

EXAMPLE 6

The following mixtures were prepared and applied on the rear of a jute-backed carpet as described in Example 3 and allowed to cure at room temperature.

| | f | g | h | i | j | k | l | m | n | o |
|---|---|---|---|---|---|---|---|---|---|---|
| Polyolefin A | 53 | 53 | 25 | 25 | 50 | — | — | — | — | — |
| Polyolefin G | — | — | — | — | — | 20 | 20 | — | — | — |
| Polyolefin H | — | — | — | — | — | — | — | 25 | — | — |
| Polyolefin J | — | — | — | — | — | — | — | — | 10 | — |
| Polyolefin K | — | — | — | — | — | — | — | — | — | 15 |
| Polythiol A | — | — | — | — | — | — | — | 25 | 33 | — |
| Polythiol E | 4 | 4 | — | — | — | — | — | — | — | — |
| Polythiol F | — | — | — | — | — | — | — | — | — | 33.7 |
| Polythiol G | — | — | 25 | 25 | — | 26.4 | — | — | — | — |
| Polythiol H | — | — | — | — | — | — | 35 | — | — | — |
| Polythiol J | — | — | — | — | 5 | — | — | — | — | — |
| China Clay | 25 | 25 | 25 | 25 | 25 | 25 | 25 | 25 | 25 | 25 |
| Diethylenetriamine | — | 0.5 | — | 0.5 | — | 0.5 | 0.5 | 0.5 | 0.5 | 0.5 |

In each case the backing adhered strongly to the fibres.

The sample of carpet which had been backed with composition g was stirred in perchloroethylene for 30 minutes at room temperature: on drying the sample, no degradation was apparent. In another experiment a further sample was stirred for 1 hour at room temperature with a 20% aqueous solution of a commercial detergent (sodium dodecylbenzene sulphonate); again, no degradation was seen.

EXAMPLE 7

Polyolefin A (31.2 g), Polythiol K (2 g), china clay (20 g), and diethylenetriamine (0.4 g) were mixed and spread evenly on the back of a sample of carpet 12 cm × 12 cm: the mixture cured within 15 minutes at room temperature to form a flexible backing.

The experiment was repeated, using 33 g of Polyolefin F in place of Polyolefin A, and using 5 g of Polythiol K: the curing time was about 1 hour.

EXAMPLE 8

Carpet backings were prepared using the following compositions:

| | P | q | r | s | t |
|---|---|---|---|---|---|
| Polyolefin A | 11.6 | 11.6 | 11.6 | — | — |
| Polyolefin G | — | — | — | 10.0 | 10.0 |
| Polythiol G | 2.8 | — | — | — | — |
| Polythiol L | — | 8.34 | — | — | — |
| Polythiol M | — | — | 5.16 | — | — |
| Polythiol N | — | — | — | 4.1 | 4.1 |
| $Na_2CO_3$ | — | — | 0.6 | — | — |
| Precipitated $CaCO_3$ (filler) | — | — | 5.6 | 7 | — |
| Cured urea-formaldehyde resin (filler) | 3.2 | 6.0 | — | — | 2.8 |
| Curing conditions | 10 mins. at 120° | 10 mins. at 120° | 10 mins. at 120° | 10 mins. at 100° | 10 mins. at 100° |

In each case the backings adhered well to the carpet.

We claim:

1. A process for backing a carpet consisting of 1. applying to the back of the carpet a curable composition comprising
   i. a polymercaptan having a molecular weight of at least 182 and at most 10,000, containing two to six mercaptan groups per average molecule,
   ii. a polyene having an average molecular weight of at least 250 and at most 10000 and containing, per average molecule, at least two ethylenic double bonds, each $\beta$ to an atom of nitrogen, sulfur, or oxygen, the sum of the mercaptan groups in the said polymercaptan and of such ethylenic double bonds in the said polyene being more than 4 but at most 8, and the polymercaptan being in a quantity sufficient to supply from 0.8 to 1.1 mercaptan groups per said ethylenic double bond of the polyene, and
2. curing the composition on the back of the carpet without the application of heat or heating to a temperature of 80° to 130°C.

2. Process according to claim 1, in which at least one of the polyene and the polymercaptan has an average molecular weight of 1000, to 6000.

3. Process according to claim 1, in which the polymercaptan is an ester of a monomercaptancarboxylic acid with a polyhydric alcohol or of a monomercaptanmonohydric alcohol with a polycarboxylic acid.

4. Process according to claim 3, in which the polymercaptan is of the formula

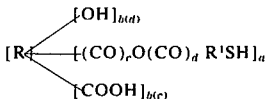

where

R represents an aliphatic or araliphatic hydrocarbon radical of 2 to 60 carbon atoms or an aliphatic or araliphatic hydrocarbon radical of 2 to 60 carbon atoms containing one ether oxygen atom, $R^1$ represents a hydrocarbon radical of 1 to 4 carbon atoms or a hydrocarbon radical of 1 to 4 carbon atoms containing one carbonyloxy group, $a$ is an integer of from 2 to 6, $b$ is zero or a positive integer of at most 3, such that $(a + b)$ is at most 6, and $c$ and $d$ each represent zero or 1, but are not the same.

5. Process according to claim 4, in which the polymercaptan is also of the formula $$R^2(OCOR^3SH)_a$$

where $a$ has the meaning assigned in claim 4, $R^2$ is an aliphatic hydrocarbon radical of from 2 to 10 carbon atoms, and $R^3$ denotes $—CH_2—$, $—(CH_2)_2—$, or $$\text{or } —\overset{CH_3}{\overset{|}{C}}H—.$$

6. Process according to claim 3, in which the polymercaptan is a polyester of formula $$R^6\text{-}(O)_gCO(O)_h\ R^4(O)_h\ CO(O)_g\ R^5SH)_f$$

where $f$ is an integer of from 1 to 6, $g$ and $h$ are each zero or 1 but are not the same, $R^4$ represents a divalent organic radical, linked through a carbon atom or carbon atoms thereof to the indicated —O— or —CO— units, $R^5$ represents a divalent organic radical, linked through a carbon atom or carbon atoms thereof to the indicated —SH group and —O— or —CO— units, and $R^6$ represents an organic radical, which must contain at least one —SH group when $f$ is 1, linked through a carbon atom or carbon atoms thereof to the indicated —O— or —CO— units.

7. Process according to claim 1, in which the polymercaptan is an ether or an ester of the general formula

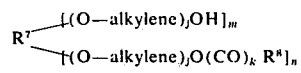

where each alkylene group contains a chain of 2 to 6, carbon atoms between consecutive oxygen atoms, $j$ is a positive integer such that the average molecular weight of the polymercaptan is 400 to 10000, $k$ is zero or 1, $m$ is zero or a positive integer such that $(m + n)$ is at most 6

$n$ is an integer of from 2 to 6, $R^7$ represents the radical of a polyhydric alcohol after removal of $(m + n)$ alcoholic hydroxyl groups, and $R^8$ represents an aliphatic radical containing at least one mercaptan group.

8. Process according to claim 7, in which the polymercaptan is of the formula

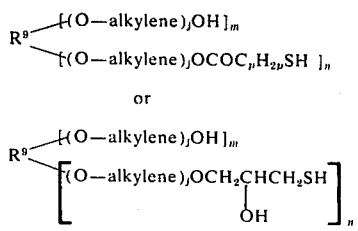

where alkylene, $j$, $m$, and $n$ have the meanings assigned in claim 8, $R^9$ represents an aliphatic hydrocarbon radical of from 2 to 6 carbon atoms, and $p$ is 1 or 2.

9. Process according to claim 1, in which the polymercaptan is of the formula

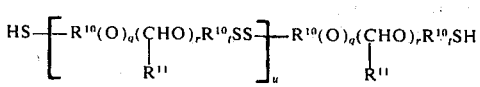

where $R^{10}$ denotes an alkylene hydrocarbon group containing from 2 to 4 carbon atoms, $R^{11}$ denotes —H, $—CH_3$, or $—C_2H_5$, $u$ is an integer which has an average value of at least 1, such that the average molecular weight of the polymercaptan is at most 10000, and either $q$ is zero, in which case $r$ and $t$ are each also zero, or $q$ is 1, in which case $r$ is zero or 1 and $t$ is 1.

10. Process according to claim 1, in which the polymercaptan is a mercaptan-terminated poly(butadiene) of the formula

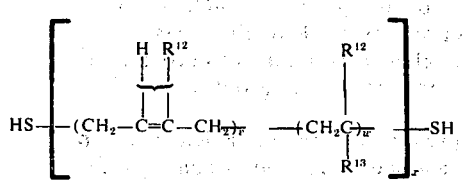

or

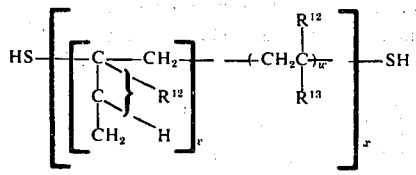

where each $R^{12}$ represents —H or $—CH_3$, $R^{13}$ represents —CN, —COOH, $—CONH_2$, $—COOR^{14}$, $—C_6H_5$, or $—OCOR^{14}$, where $R^{14}$ is an alkyl group of one to eight carbon atoms, $v$ is an integer of at least one, $w$ is zero or a positive integer, and $x$ is an integer such that the average number molecular weight of the polymercaptan is 500 to 10000.

11. Process according to claim 1, in which the polymercaptan is of the formula

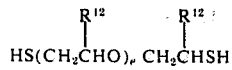

where each $R^{12}$ represents —H or $—CH_3$, and $e$ is an integer of 1 to 4.

12. Process according to claim 1, in which the polyene has at least two ethylenic double bonds each $\alpha$ to a carbonyloxy group.

13. Process according to claim 12, in which the polyene is of the formula

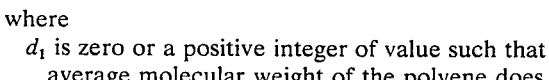

where $d_1$ is zero or a positive integer of value such that the average molecular weight of the polyene does not exceed 10000, $e_1$ is zero or 1, $c_1$ is an integer of 1 to 6, $R^{15}$ denotes a radical of 3 to 60 carbon atoms remaining after removal of $c_1$ OH groups from a compound having at least $c_1$ alcoholic or phenolic hydroxyl groups or the acyl radical remaining after removal of $c_1$ OH groups from a compound having at least $c_1$ COOH groups, each alkylene group contains a chain of 2 to 6 carbon atoms between consecutive oxygen atoms, $R^{16}$ represents a group of formula —OH or $—OOCR^{18}$, where $R^{18}$ represents —H, or a monovalent hydrocarbon group or a monovalent hydrocarbon group bearing carboxyl or alkoxycarbonyl substituents, and $R^{17}$ represents —H, an acyl group, or the residue, after removal of an OH group, of an alcohol, with the provisos that $R^{15}$ and $R^{17}$ do not both represent acyl when $d_1$ and $e_1$ both denote zero and that $R^{17}$ does not represent —H when $e_1$ is 1, there being a total of at least two ethylenic double bonds $\alpha$ to carbonyloxy groups in the said polyene.

14. Process according to claim 1, in which the composition contains a Brønsted base as accelerator.

15. Process according to claim 1, in which the composition contains a Brønsted acid or a free-radical catalyst as accelerator.

16. Process according to claim 1, in which the composition is applied as a foam formed from a carbonate or bicarbonate of an alkali metal or of an alkaline earth metal and a polyene of formula

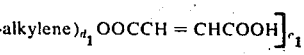

where $R^{15}$ denotes a radical of 3 to 60 carbon atoms remaining after removal of $c_1$ OH groups from a compound having at least $c_1$ alcoholic or phenolic hydroxyl groups or the acyl radical remaining after removal of $c_1$ OH groups from a compound having at least $c_1$ COOH groups, each alkylene group contains a chain of two to six carbon atoms between consecutive oxygen atoms, $c_1$ is an integer of 1 to 6, and $d_1$ is zero or a positive integer of value such that the average molecular weight of the polyene does not exceed 10000.

17. Carpets having a backing which is a cured composition comprising i. a polymercaptan having a molecular weight of at least 182 and at most 10,000, containing two to six mercaptan groups per average molecule, and ii. a polyene having an average molecular weight of at least 250 and at most 10000 and containing, per average molecule, at least two ethylenic double bonds, each $\beta$ to an atom of nitrogen, sulfur, or oxygen, the sum of the mercaptan groups in the said polymercaptan and of such ethylenic double bonds in the said polyene being more than 4 and at most 8, and the polymercaptan being in a quantity sufficient to supply from 0.8 to 1.1 mercaptan groups per said ethylenic double bond of the polyene.

* * * * *